US011129414B2

(12) United States Patent
Atkins et al.

(10) Patent No.: US 11,129,414 B2
(45) Date of Patent: Sep. 28, 2021

(54) THERMAL WICK FOR ELECTRONIC VAPORIZERS

(71) Applicant: JUUL LABS, INC., San Francisco, CA (US)

(72) Inventors: Ariel Atkins, San Francisco, CA (US); Alexander J. Gould, Portola Valley, CA (US); Esteban Leon Duque, San Francisco, CA (US); James Monsees, San Francisco, CA (US)

(73) Assignee: JUUL Labs, Inc., San Francisco, CA (US)

( * ) Notice: Subject to any disclaimer, the term of this patent is extended or adjusted under 35 U.S.C. 154(b) by 303 days.

(21) Appl. No.: 15/855,890

(22) Filed: Dec. 27, 2017

(65) Prior Publication Data

US 2018/0177240 A1 Jun. 28, 2018

Related U.S. Application Data

(60) Provisional application No. 62/439,417, filed on Dec. 27, 2016.

(51) Int. Cl.

| | |
|---|---|
| ***A24F 47/00*** | (2020.01) |
| ***A24F 40/44*** | (2020.01) |
| ***H05B 3/06*** | (2006.01) |
| *A24F 40/10* | (2020.01) |

(52) U.S. Cl.

CPC ..... *A24F 40/44* (2020.01); *H05B 3/06* (2013.01); *A24F 40/10* (2020.01)

(58) Field of Classification Search

CPC ..... A24F 40/44; A24F 47/008

See application file for complete search history.

(56) References Cited

U.S. PATENT DOCUMENTS

| | | | |
|---|---|---|---|
| 6,155,268 | A | 12/2000 | Takeuchi |
| 6,909,840 | B2 | 6/2005 | Harwig et al. |
| 9,072,321 | B2 | 7/2015 | Liu |
| 9,320,300 | B2 | 4/2016 | Hon |
| 9,648,909 | B2 | 5/2017 | Zhou et al. |

(Continued)

FOREIGN PATENT DOCUMENTS

| | | | |
|---|---|---|---|
| CA | 2935072 | C | 5/2018 |
| CN | 103859604 | A | 6/2014 |

(Continued)

OTHER PUBLICATIONS

Certified Copy of GB Patent Application No. 1511359.0, filed Jun. 29, 2015, entitled "Electronic Vapour Provision System".

*Primary Examiner* — Eric Yaary

(74) *Attorney, Agent, or Firm* — Mintz Levin Cohn Ferris Glovsky and Popeo, P.C.

(57) ABSTRACT

Vaporizers having a thermal wick are provided. A thermal wick may include a combination of an electrically insulating porous wicking material surrounding, enclosing, covering or embedded within a thermally conductive material. The thermally conductive material has a thermal conductance greater than that of the porous wicking material. The thermal wick reduces the viscosity of vaporizable material by transferring heat throughout the wick and warming the vaporizable material and providing a high void volume. The thermal wick allows for substantially higher total particulate masses of vaporizable material than traditional wicks.

24 Claims, 11 Drawing Sheets

(56) References Cited

U.S. PATENT DOCUMENTS

| | | | | |
|---|---|---|---|---|
| 9,675,118 | B2 | 6/2017 | Chen | |
| 9,943,108 | B2 | 4/2018 | Lord | |
| 9,986,761 | B2 | 6/2018 | Thorens et al. | |
| 9,986,762 | B2 | 6/2018 | Alarcon et al. | |
| 9,999,250 | B2 | 6/2018 | Minskoff et al. | |
| 10,010,695 | B2 | 7/2018 | Buchberger | |
| 10,039,321 | B2 | 8/2018 | Verleur et al. | |
| 10,045,562 | B2 | 8/2018 | Buchberger | |
| 10,058,129 | B2 | 8/2018 | Monsees et al. | |
| 10,080,387 | B2 | 9/2018 | Phillips et al. | |
| 10,085,485 | B2 | 10/2018 | Hunt et al. | |
| 10,159,282 | B2 | 12/2018 | Monsees et al. | |
| 2003/0215335 | A1 | 11/2003 | Crivelli | |
| 2009/0230117 | A1 | 9/2009 | Fernando et al. | |
| 2010/0253281 | A1 | 10/2010 | Li | |
| 2011/0226236 | A1 | 9/2011 | Buchberger | |
| 2013/0042865 | A1 | 2/2013 | Monsees et al. | |
| 2013/0056013 | A1 | 3/2013 | Terry et al. | |
| 2013/0104916 | A1 | 5/2013 | Bellinger et al. | |
| 2013/0192623 | A1 | 8/2013 | Tucker et al. | |
| 2013/0213419 | A1 | 8/2013 | Tucker et al. | |
| 2013/0255702 | A1 | 10/2013 | Griffith, Jr. et al. | |
| 2013/0284192 | A1 | 10/2013 | Peleg et al. | |
| 2013/0306064 | A1 | 11/2013 | Thorens et al. | |
| 2014/0000638 | A1 | 1/2014 | Sebastian et al. | |
| 2014/0069424 | A1 | 3/2014 | Poston et al. | |
| 2014/0109921 | A1 | 4/2014 | Chen | |
| 2014/0261488 | A1 | 9/2014 | Tucker | |
| 2014/0299137 | A1 | 10/2014 | Kieckbusch et al. | |
| 2015/0181944 | A1 | 7/2015 | Li et al. | |
| 2015/0208728 | A1* | 7/2015 | Lord | A24F 7/00 131/329 |
| 2015/0208729 | A1 | 7/2015 | Monsees et al. | |
| 2015/0217068 | A1 | 8/2015 | Wakalopulos | |
| 2015/0237916 | A1 | 8/2015 | Farine et al. | |
| 2015/0305408 | A1 | 10/2015 | Liu | |
| 2015/0357839 | A1 | 12/2015 | Cai et al. | |
| 2016/0057811 | A1 | 2/2016 | Alarcon et al. | |
| 2016/0135505 | A1* | 5/2016 | Li | A24F 47/008 131/329 |
| 2016/0174611 | A1 | 6/2016 | Monsees et al. | |
| 2016/0192707 | A1 | 7/2016 | Li et al. | |
| 2016/0295915 | A1 | 10/2016 | Jochnowitz et al. | |
| 2016/0309786 | A1 | 10/2016 | Holtz et al. | |
| 2016/0331035 | A1 | 11/2016 | Cameron | |
| 2016/0334119 | A1 | 11/2016 | Cameron | |
| 2016/0341419 | A1 | 11/2016 | Fluhrer | |
| 2016/0360790 | A1 | 12/2016 | Calfee et al. | |
| 2017/0006916 | A1 | 1/2017 | Liu | |
| 2017/0027223 | A1 | 2/2017 | Eksouzian | |
| 2017/0027232 | A1 | 2/2017 | Scheck et al. | |
| 2017/0043106 | A1 | 2/2017 | Hyland et al. | |
| 2017/0043910 | A1 | 2/2017 | Hopps et al. | |
| 2017/0056883 | A1 | 3/2017 | Aarts et al. | |
| 2017/0112193 | A1* | 4/2017 | Chen | A24F 47/008 |
| 2017/0135399 | A1 | 5/2017 | Gavrielov et al. | |
| 2017/0156399 | A1 | 6/2017 | Freeman et al. | |
| 2017/0196263 | A1 | 7/2017 | Sur | |
| 2017/0215481 | A1 | 8/2017 | Li et al. | |
| 2017/0224018 | A1 | 8/2017 | Li et al. | |
| 2017/0231276 | A1 | 8/2017 | Mironov et al. | |
| 2017/0231282 | A1 | 8/2017 | Bowen et al. | |
| 2017/0231286 | A1 | 8/2017 | Borkovec et al. | |
| 2017/0233114 | A1 | 8/2017 | Christensen et al. | |
| 2017/0238617 | A1 | 8/2017 | Scatterday | |
| 2017/0259170 | A1 | 9/2017 | Bowen et al. | |
| 2017/0280779 | A1 | 10/2017 | Qiu | |
| 2017/0340018 | A1 | 11/2017 | Thorens | |
| 2017/0367402 | A1 | 12/2017 | Lau et al. | |
| 2017/0367407 | A1 | 12/2017 | Althorpe et al. | |
| 2018/0027877 | A1 | 2/2018 | Tucker et al. | |
| 2018/0027879 | A1 | 2/2018 | Gavrielov et al. | |
| 2018/0037381 | A1 | 2/2018 | White et al. | |
| 2018/0043115 | A1 | 2/2018 | Gould et al. | |
| 2018/0077967 | A1 | 3/2018 | Hatton et al. | |
| 2018/0098576 | A1 | 4/2018 | Hedarchet | |
| 2018/0110263 | A1 | 4/2018 | Borkovec et al. | |
| 2018/0116292 | A1 | 5/2018 | Atkins et al. | |
| 2018/0146711 | A1 | 5/2018 | Mazur et al. | |
| 2018/0160735 | A1 | 6/2018 | Borkovec et al. | |
| 2018/0160737 | A1 | 6/2018 | Verleur et al. | |
| 2018/0162769 | A1 | 6/2018 | Peuchert et al. | |
| 2018/0168227 | A1* | 6/2018 | Fraser | A24F 47/008 |
| 2018/0220707 | A1 | 8/2018 | Biel et al. | |
| 2019/0246693 | A1 | 8/2019 | Nettenstrom et al. | |

FOREIGN PATENT DOCUMENTS

| | | | |
|---|---|---|---|
| CN | 105011375 | A | 11/2015 |
| CN | 105394816 | A | 3/2016 |
| EP | 2925395 | A1 | 10/2015 |
| EP | 3078281 | A1 | 10/2016 |
| EP | 3170414 | A1 | 5/2017 |
| GB | 2504076 | A | 1/2014 |
| KR | 200461404 | Y1 | 7/2012 |
| WO | WO-2011146174 | A2 | 11/2011 |
| WO | WO-2013060781 | A1 | 5/2013 |
| WO | WO-2014150979 | A2 | 9/2014 |
| WO | WO-2015107552 | A1 | 7/2015 |
| WO | WO-2016023809 | A1 | 2/2016 |
| WO | WO-2016/079155 | A1 | 5/2016 |
| WO | WO-2016145072 | A1 | 9/2016 |
| WO | WO-2017001352 | A2 | 1/2017 |
| WO | WO-2017093535 | A1 | 6/2017 |
| WO | WO-2017176111 | A1 | 10/2017 |
| WO | WO-2017/207443 | A1 | 12/2017 |
| WO | WO-2018078546 | A2 | 5/2018 |

* cited by examiner

THERMAL WICK FOR ELECTRONIC VAPORIZERS

CROSS REFERENCE TO RELATED APPLICATIONS

This application claims priority to U.S. Provisional Patent Application No. 62/439,417, filed on Dec. 27, 2016 and entitled "Thermal Wick for Electronic Vaporizers," the contents of which is herein incorporated by reference in its entirety.

FIELD

The apparatuses and methods described herein relate to electronic cigarettes ("vaporizers").

BACKGROUND

Electronic vaporizers (e.g., vaporizers, including e-cigarettes/cannabis oil cartridge vaporizers) typically use a basic atomizer system that includes a wicking element with a resistive heating element wrapped around the wicking element or positioned within a hollow wicking element. The wicking element serves at least two purposes: to draw liquid from a reservoir to the atomizer where it can be vaporized by the coil, and to allow air to enter the reservoir to replace the volume of liquid removed. When a user inhales on the vaporizer, the coil heater may be activated, and incoming air may pass over the saturated wick/coil assembly, stripping off vapor, which condenses and enters the user's lungs. During and/or after the puff, capillary action pulls more liquid into the wick and air returns to the reservoir through the wick.

SUMMARY

Aspects of the current subject matter relate to a thermal wick for user in a vaporizer device. A thermal wick configuration consistent with implementations described herein enhances performance of a vaporizer in vaporizing a vaporizable material. An increased thermal conductivity of the wick (due to addition of a thermally conductive material) allows the length of the wick to reach higher temperatures. This increase in temperature lowers the viscosity of the fluid in the wick, and in the reservoir. This lowered viscosity in turns allows bulk flow/capillary action through the wick to happen at a faster rate and allows air to return to the reservoir through the wick with less pressure drop.

In accordance with one implementation of the current subject matter, a cartridge for a vaporization device includes a mouthpiece, a reservoir configured to hold a vaporizable material, a wick configured to draw the vaporizable material from the reservoir to a vaporization region, and a heating element disposed near the vaporization region and configured to heat the vaporizable material drawn from the tank. The wick includes a thermally conductive core and a porous wicking material surrounding at least a portion of the thermally conductive core, the thermally conductive core being more thermally conductive than the porous wicking material.

In accordance with another implementation of the current subject matter, a method includes drawing, through a wick, a vaporizable material from a reservoir of a vaporization device to a vaporization region. The vaporization region is heated with a heating element disposed near the vaporization region to cause vaporization of the vaporizable material, the heating resulting in increased heat transfer through the wick causing a decrease in viscosity in the vaporizable material. The vaporized vaporizable material is entrained in a flow of air to a mouthpiece of the vaporization device. The wick includes a thermally conductive core and a porous wicking material surrounding at least a portion of the thermally conductive core, the thermally conductive core being more thermally conductive than the porous wicking material.

BRIEF DESCRIPTION OF THE DRAWINGS

The accompanying drawings, which are incorporated in and constitute a part of this specification, show certain aspects of the subject matter disclosed herein and, together with the description, help explain some of the principles associated with the disclosed implementations. In the drawings:

FIGS. 5A,5B-9A,9B illustrate, through perspective and cross-sectional views, features of various wicks consistent with implementations of the current subject matter;

DETAILED DESCRIPTION

Implementations of the current subject matter include devices relating to vaporizing of one or more materials for inhalation by a user. The term "vaporizer" is used generically in the following description and refers to a vaporizer device. Examples of vaporizers consistent with implementations of the current subject matter include electronic vaporizers, electronic cigarettes, e-cigarettes, or the like. In general, such vaporizers are often portable, frequently handheld devices that heat a vaporizable material to provide an inhalable dose of the material.

More specifically, implementations of the current subject matter include a heated or thermal wick, or a wick that combines a resistive heating element and a fibrous wicking material. Such wicks are referred to herein as thermal wicks, hybrid wicks, heating wicks, or the like.

Traditionally, vaporizer devices have utilized a wick typically formed of a silica or cotton material. The traditional silica wick material is formed by bundling together fine, continuous filaments of silica glass or cotton fibers, first into threads, which are then bundled together to form the cord or rope used as the wick. The cord may typically be specified by a nominal outer diameter, number of threads, and/or a TEX value indicating a linear density.

This wicking arrangement, however, has a number of shortcomings. A capillary flow rate, a rate at which liquid is drawn into and along the length of the wick, is not as high as desired by some users with this traditional wicking arrangement. That is, during use of a vaporizer device, liquid may not be replenished as quickly as desired for a user as the liquid evaporates from a heated region of the wick and more liquid needs to travel along the length of the wick for replenishment. This may be particularly true with more viscous fluids, such as cannabis oil for example. High-viscosity solutions may further reduce the capillary flow rate into the wick and also reduce the rate at which air can return to the reservoir, which even further reduces the capillary flow rate.

A thermal wick consistent with implementations of the current subject matter has an improved capillary flow rate into the thermal wick and an increase in total particulate mass (TPM), as compared to a wick with the traditional silica or cotton wick material. This allows for rapid wick saturation and air exchange. Because of this, a user can take successive long puffs without noticing much difference in vapor production as the liquid quickly (e.g., within seconds) replenishes in the thermal wick.

Additionally, a thermal wick consistent with implementations of the current subject matter distributes excess temperatures along the wick, reducing or eliminating hot spots and cold spots that are common in a wick made with the traditional silica or cotton wick material. The thermal wick also has an increased heat-up time compared to that of the traditional silica or cotton wick.

Figure 1:
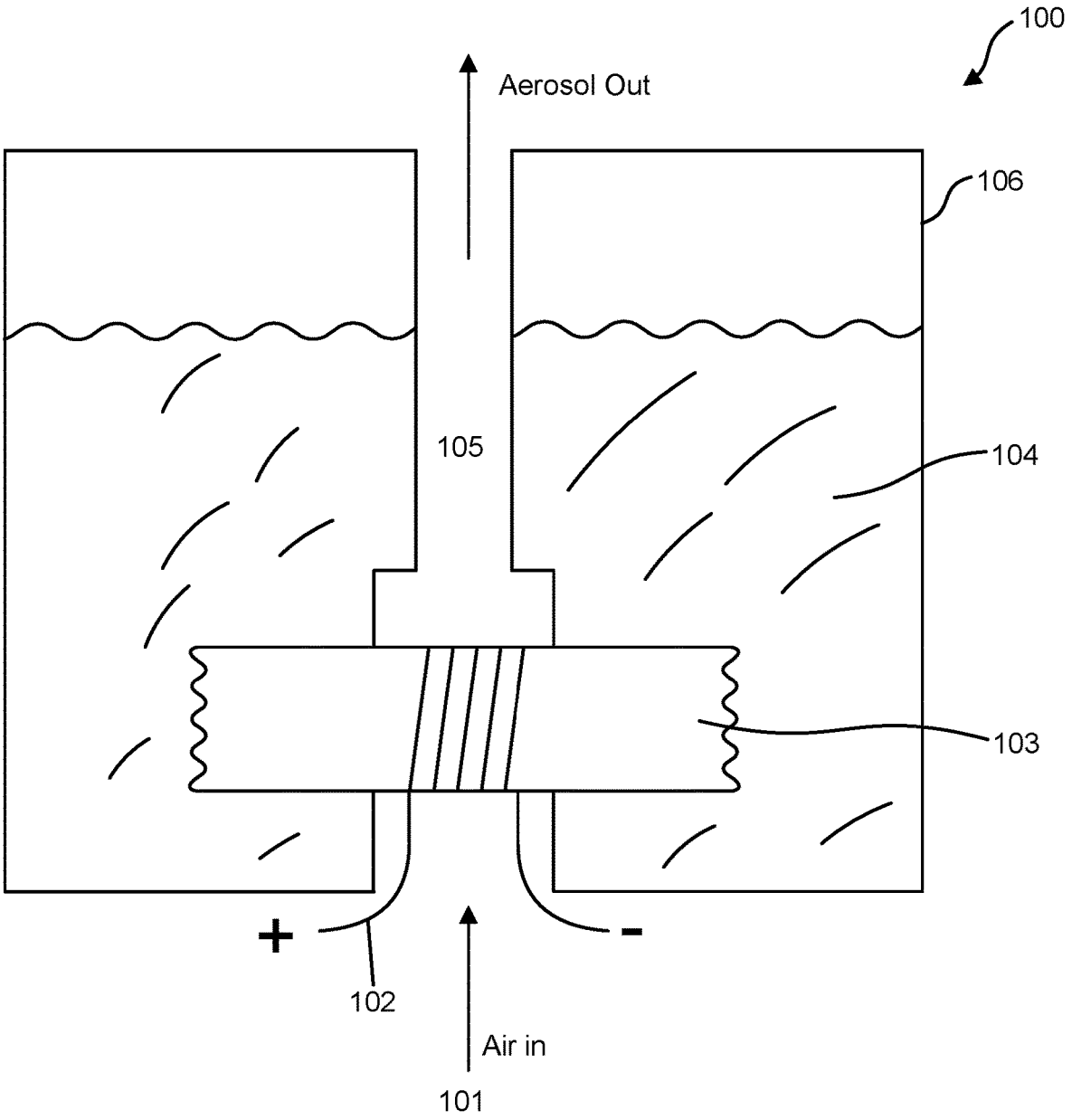
FIG. 1 illustrates a schematic representation of an apparatus in which a wick consistent with implementations of the current subject matter may be incorporated.

FIG. 1 illustrates a schematic representation of a cartridge 100 in which a thermal wick 103 consistent with implementations of the current subject matter may be incorporated. The cartridge 100 includes a tank or reservoir 106 for holding a vaporizable material 104 such as a liquid, gel, solid, semi-solid, or wax vaporizable material including but not limited to cannabis oil, glycerol, vegetable glycerin, glycol, propylene glycol, water, flavorants, additives, and/or the like. The vaporizable material 104 may include one or more active agents, including cannabinoids, terpenes, or any combinations thereof.

In FIG. 1, the tank 106 is shown in two parts (left and right); the two parts may be connected and continuous, or separate halves may be used (e.g., holding different vaporizable material components). An air path 105 extends through the cartridge 100, and in particular through the tank 106 of the cartridge 100. As shown, air may be drawn in from the bottom or base of the cartridge 100 at an air inlet 101 and pulled over and/or around a heating element 102 and the thermal wick 103. The vaporizing/atomizer heating element (e.g., a resistive heating coil) 102 may be wrapped around or embedded within the thermal wick 103. Although a thermally conductive material of the thermal wick 103 is typically electrically isolated from the heating element 102 by a porous wicking material of the thermal wick 103 having a lower thermal conductivity, when power is applied to the heating element 102 to vaporize the vaporizable material, the thermal wick 103 is heated by conduction and/or convection. The thermal wick 103 may be heated to a temperature that is below a vaporization temperature.

The air path 105 through the cartridge 100 passes through the tank 106, and a mouthpiece (not shown in FIG. 1) may be present at the proximal end of the tank 106. A heating chamber, holding the thermal wick 103 and the heating element/coil 102, may be an internal (e.g., surrounded, 360°, on the sides by the tank 106) chamber through which the airflow passes.

The thermal wick 103 draws the vaporizable material 104 from the reservoir 106, axially from both ends of the thermal wick 103, where it may be held by surface tension and atmospheric pressure. When a user puffs on a mouthpiece of the cartridge 100, air flows into the inlet 101. Simultaneously or near simultaneously, the heater coil 102 may be activated, e.g., by a pressure sensor, pushbutton, or other means. The incoming air flows over the heated wick/coil, stripping away vaporized oil, where it is condensed in and exits as an aerosol from the air-path 105.

In some variations of the current subject matter, the thermal wick 103 may operate independently of the heating/vaporizing coil 102. In some variations, the thermal wick 103 is passively heated by the heating coil 102. In some variations, the thermal wick 103 may be heated separately or additionally from the heating/vaporizing coil 102, and may be, for example, heated by a separate heater or region of the vaporizing coil. A separate (typically lower-temperature/warming) heater, which is also referred to herein as a wick heater, may therefore be thermally connected to the thermally conductive portion(s) of the thermal wick 103, and this separate heater may be driven off of a separate heating circuit from the heating/vaporizing heating coil 102. Alternatively, the wick heater (warming heater) may be driven from the same control circuit of the heating coil 102 (or, for example, connected in series or parallel to the control circuit and/or the heating coil). Thus, in some variations, the thermal wick 103 may be heated while the device is "on", even when the heating coil of the vaporizer/atomizer 102 is not active.

Figure 2:
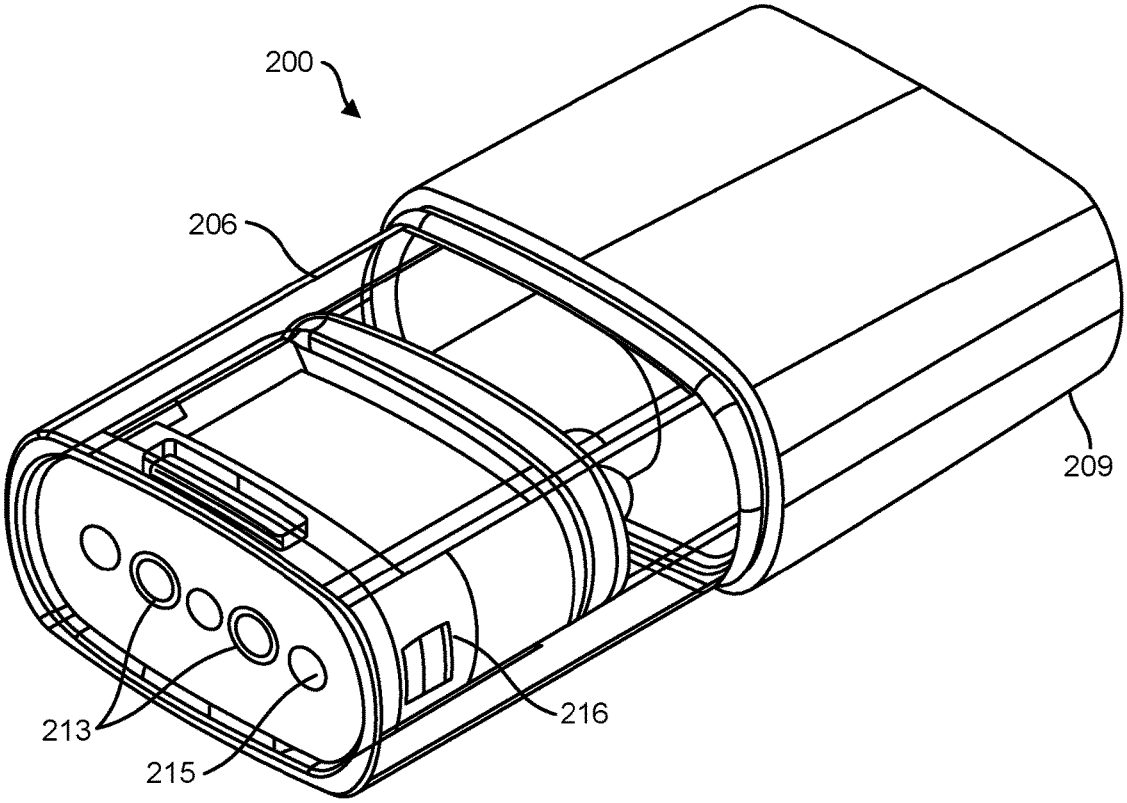
FIG. 2 illustrates, via a perspective view, a cartridge in which a wick consistent with implementations of the current subject matter may be incorporated.
Figure 3:
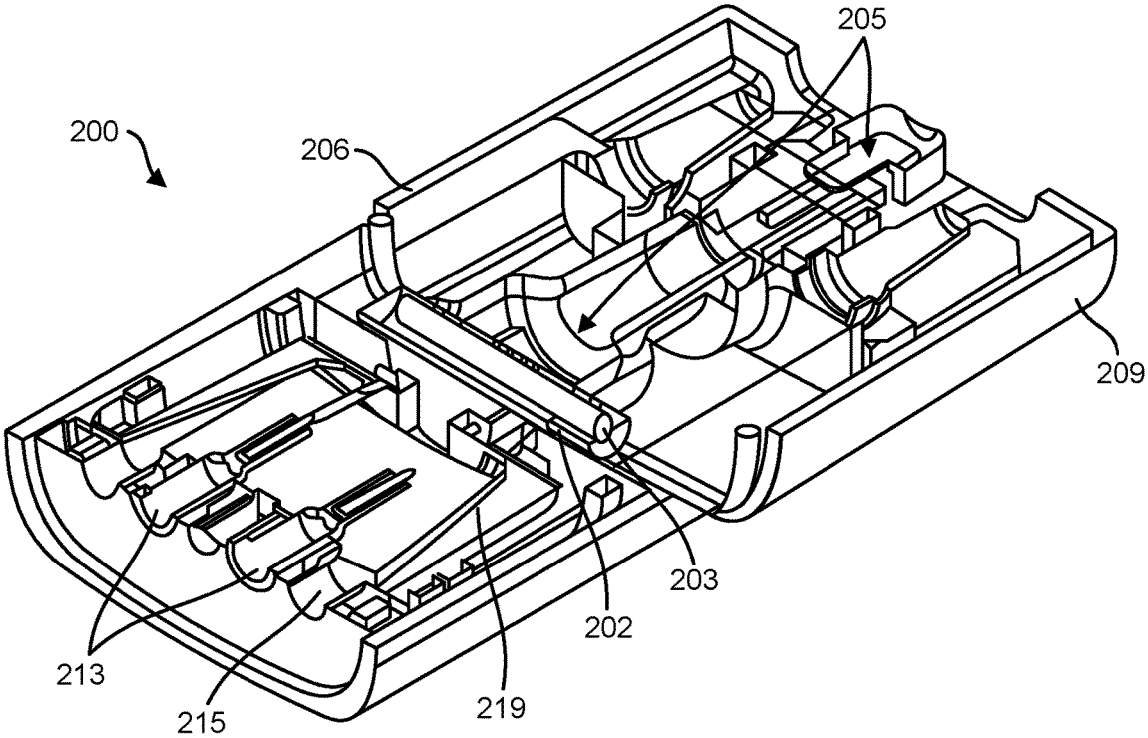
FIG. 3 illustrates, via a cross-sectional view, the cartridge of FIG. 2, showing the wick and other internal components.

FIG. 2 illustrates, via a perspective view, and FIG. 3 illustrates, via a cross-sectional view, a cartridge 200 in which a thermal wick 203 consistent with implementations of the current subject matter may be incorporated.

The cartridge 200 includes a reservoir or tank 206, which may be, for example, transparent or translucent, a proximal mouthpiece 209, a set of pin connectors 213 at a distal end, and openings 215 into an overflow leak chamber 216 (which may include one or more absorbent pads 219 for soaking up leakage of the vaporizable material), as well as a thermal wick 203. The thermal wick 203 may be wrapped with a resistive heating element (coil 202), which may be connected by conductive wires to pin inputs. An air path 205 extends through the tank 206, as shown in FIG. 3.

A thermal wick, consistent with implementations of the current subject matter, may include a combination of an electrically insulating porous wicking material surrounding, enclosing, covering, or embedded within a thermally conductive material.

The porous wicking material may form an outer sleeve or cover, and may be made from any braided, stranded, or amorphous material which is not electrically conductive and which is stable at vaporization temperatures. The porous wicking material may be silica, cotton, glass (e.g., glass fibers), fiberglass, ceramic, or another porous material. According to some aspects of the current subject matter, the porous wicking material may be any porous material that electrically isolates the thermally conductive material and/or that is characterized by having a plurality of voids or spaces along its length to permit the transfer and flow of liquid along its length. In some implementations, the porous wicking material can be a perforated material or tube. The porous wicking material may be characterized as having a low thermal conductivity, for example, materials with a thermal conductivity less than 3 W/mK (e.g., at or near 25° C.) may be referred to as low thermal conductivity materials. Other thresholds may be established for characterizing a material as a low thermal conductivity material.

The thermally conductive material may be a resistive heating material and/or a material having a high thermal conductivity. The thermally conductive material may be characterized as a material having a thermal conductance that is greater than that of the porous wicking material. For example, the thermal conductance of the thermally conductive material may be at least about 5% greater than that of the porous wicking material. The thermal conductance of the thermally conductive material may be greater than that of the porous wicking material by 3, 4, 5, 6, 7, 8, or 9 W/mK. The thermal conductivity at or near room temperature of the thermally conductive material in the thermal wick may be greater than 5×, 10×, 15×, 20×, etc. the thermal conductivity of standard wicking materials, such as cotton, silica, etc. Other thresholds may be established for characterizing a material as a high thermal conductivity material. Examples of the thermally conductive materials include but are not limited to copper (which has a high thermal conductivity of approximately 385 W/mK), steel, stainless steel, aluminum, titanium, nickel, or any metal/metal combination. In some implementations, the thermally conductive material is non-reactive with the vaporizable material. In some implementations in which the thermally conductive material is a reactive material, a coating or plating (e.g., an inert plating) may also be incorporated.

A thermal wick, consistent with implementations of the current subject matter, may be characterized as a bulk material having an increased thermal conductivity compared to traditional silica or cotton wicks, and where the bulk material has an electrical conductivity needed for isolation with the heating element. For example, in one variation, the thermal wick may be a ceramic (or other porous material) wick in a tube or cylinder form with thermally conductive particles (e.g., copper flakes or pieces) embedded or dispersed throughout.

The thermally conductive material may be considered as a "core" of a thermal wick, in which the thermally conductive core (which may be one piece or a multitude of pieces) is surrounded or substantially surrounded by a porous wicking material. In some aspects, substantially surrounded refers to the thermally conductive material being embedded with or dispersed within a porous wicking material to provide an increased thermal conductivity compared to the porous wicking material alone and where the thermal wick provides sufficient electrical isolation from the heating element.

According to implementations of the current subject matter, thermal conductivity as used herein refers to an aggregate thermal conductance of one or more materials, where the thermal conductivity is a function of properties of the material/materials as well as geometry of the material/materials (e.g., the thermal conductance of a material may be different when used in different configurations and geometries).

FIGS. 4-9B illustrate, through various views, features of various thermal wick configurations consistent with implementations of the current subject matter.

Figure 4:
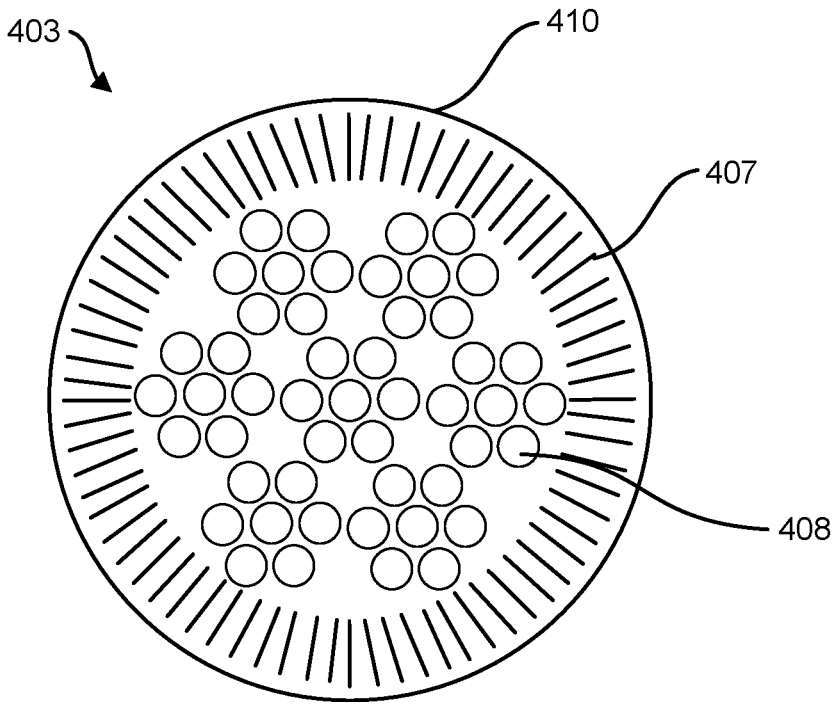
FIG. 4 illustrates, via a cross-sectional view, features of a wick consistent with implementations of the current subject matter.

In FIG. 4, a cross-section of a thermal wick 403 is shown. The thermal wick 403 includes a porous wicking material 407, which may be a bundle of fibers, such as is silica fibers. A thermally conductive core 408 may form a central core region of the thermal wick 403. The porous wicking material 407 surrounds or substantially surrounds the thermally conductive core 408. Additionally, a separate sleeve (e.g., a thin sleeve) 410 made of a porous wicking material may surround the silica fibers making up the porous wicking material 407. The separate sleeve 410 is not necessary in all implementations.

The silica fibers may, in some example implementations, be a bundle of roughly 17,000 silica fibers, each approximately with a 0.009 mm diameter, with the bundle constrained to a diameter of ~2 mm and cut to a length of approximately 10 mm. An axial thermal conductivity of the porous wicking material, in an example implementation, is ~1.4 W/mK. The thermally conductive core 408 may be made of, for example, a stainless steel rope made from multiple twisted bundles of wire each containing individual strands of wire. In an example implementation, the wires are each approximately 0.15 mm diameter/strand, and the overall rope diameter is approximately 1.5 mm. The porous wicking material 407 may be a braided silica sleeve. In an example implementation, the overall outside diameter of the thermal wick 403 may be ~2 mm, although other diameters may be used, including, for example, 0.5 mm to 5 mm diameters.

As shown in FIG. 4, a majority portion of the thermal wick 403 may include the stainless steel fibers making up the thermally conductive core 408. This greatly increases the void volume and also increases the thermal conductivity of the bulk to, for example, ~15 w/mK. The silica sleeve in this example may serve a dual purpose: it may prevent the heating coil, which is wrapped around the thermal wick 403, from shorting on the metal core, and it may also provide a capillary path to mitigate leakage through and around the metal core.

As shown in FIG. 4, the less thermally conductive porous wicking material 407 surrounds, on the radial sides, the thermally conductive core 408 to electrically isolate and protect the heating coil from shorting. The thermally conductive core 408 may be exposed at the ends to aid in the heating of the vaporizable material.

Figure 5A:
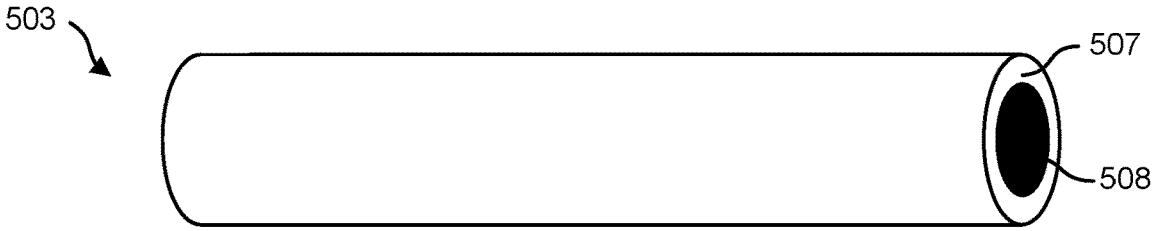
Figure 5B:
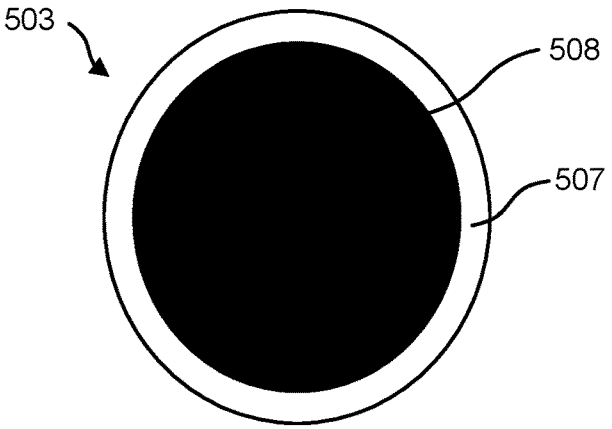

FIGS. 5A and 5B illustrate, through a perspective and a cross-sectional view, respectively, features of a thermal wick 503 consistent with an additional implementation of the current subject matter.

A thermally conductive core 508 forms a core extending the length of the thermal wick 503, and is radially surrounded by a material having a lower thermal conductivity, porous wicking material 507. The ends of the thermally conductive core 508 may be exposed, as shown in FIGS. 5A and 5B.

Figure 6A:
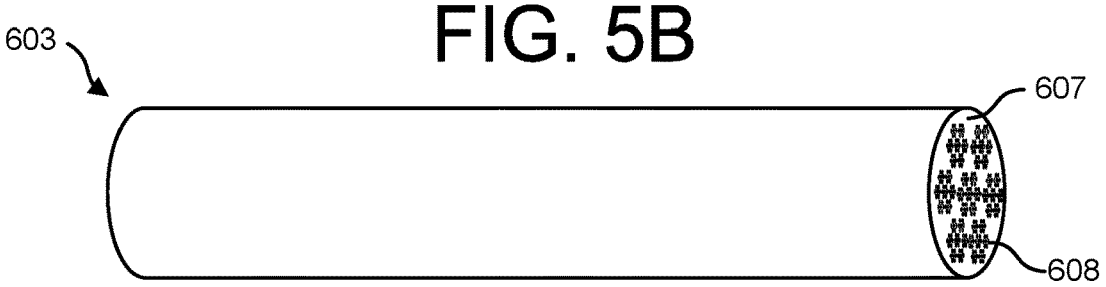
Figure 6B:
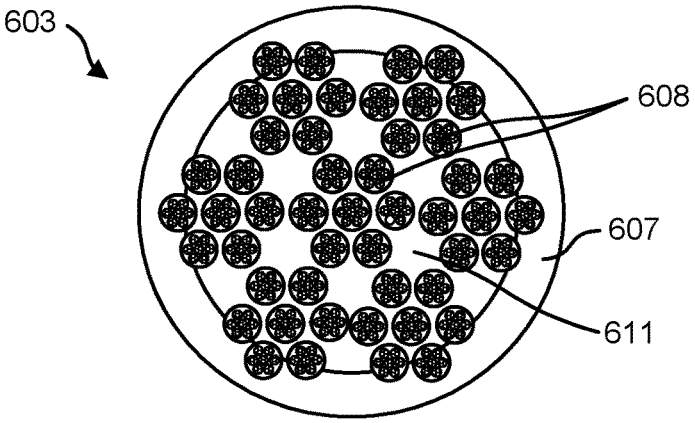

FIGS. 6A and 6B illustrate, through a perspective and a cross-sectional view, respectively, features of a thermal wick 603 consistent with an additional implementation of the current subject matter.

The thermal wick 603 has an inner core region made up of thermally conductive components or strands 608 and gaps or voids 606 between the strands 608. The gaps or voids 606 may be air gaps, for example. A porous wicking material 607 surrounds the inner core region of thermally conductive strands 608 and voids 606.

In FIGS. 5A-6B the outer wicking material 507, 607 may be formed as a sleeve or cover that extends the length of the thermal wick 503, 603 for inserting into the tank of vaporizable material on both ends.

Figure 7A:
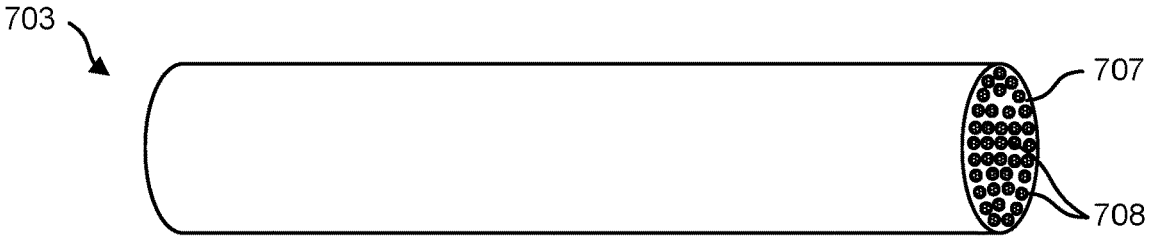
Figure 7B:
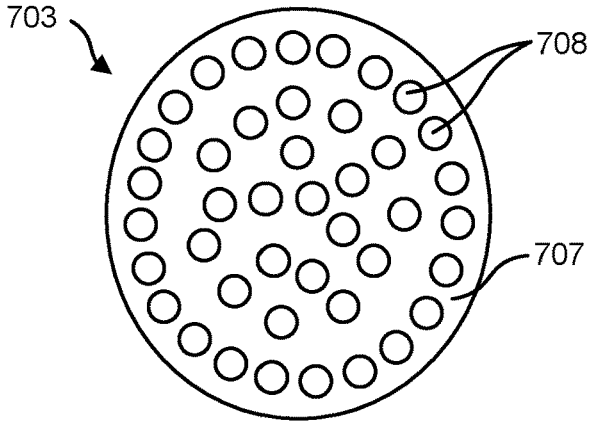

FIGS. 7A and 7B illustrate another example of a thermal wick 703 including a core 708 with a high thermal conductivity material (e.g., wires, braids, fibers, etc. of stainless steel, for example) extending through the volume of the thermal wick 703 and surrounded by a porous wicking material 707 having a lower thermal conductivity and being electrical conductive. As shown in FIGS. 7A and 7B, the high thermal conductivity material may be evenly or near evenly distributed through the volume of the thermal wick 703. The thermal wick 703 may also include internal void or gap regions (e.g., around the high thermal conductivity material). The individual strands of high thermal conductivity material (as shown in the sectional/end view of FIG. 7B and at the end of FIG. 7A) may be woven, braided, or otherwise in thermal contact with each other at various points along the length of the thermal wick 703.

Figure 8A:
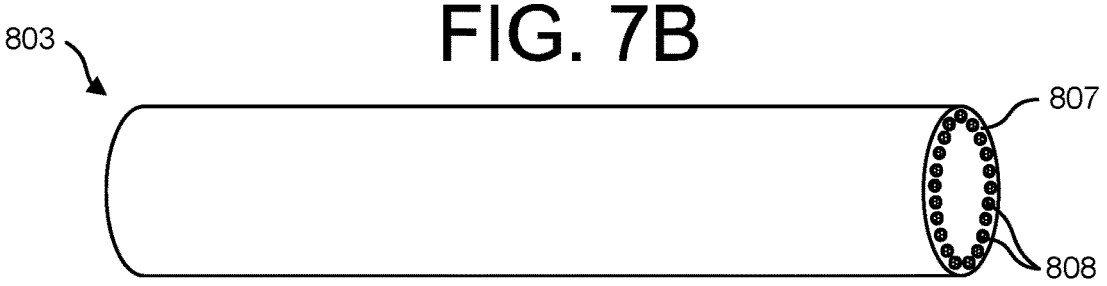
Figure 8B:
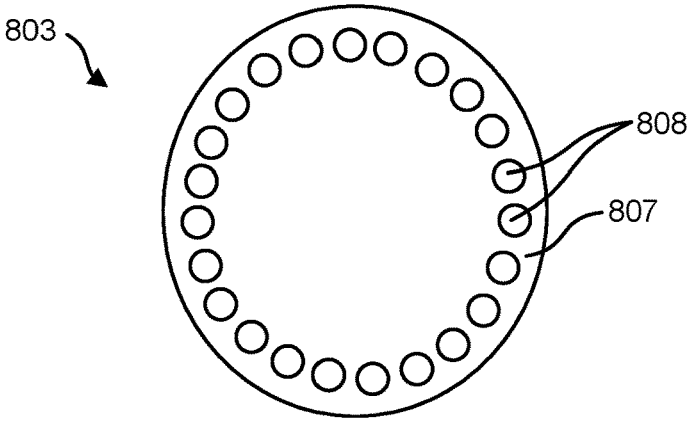

FIGS. 8A and 8B illustrate another exemplary thermal wick, thermal wick 803 including a plurality of high thermal conductivity strands, braids, wires, or the like 808, arranged around an inner peripheral region that is covered by the porous outer, lower thermal-conductivity material 807. In this example, the central region may be the same material as the outer wicking material, providing a larger cross-sectional area for wicking.

Figure 9A:
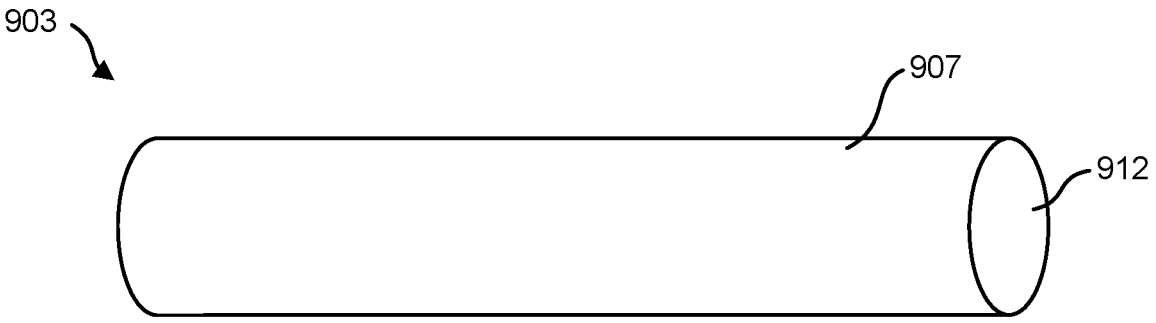
Figure 9B:
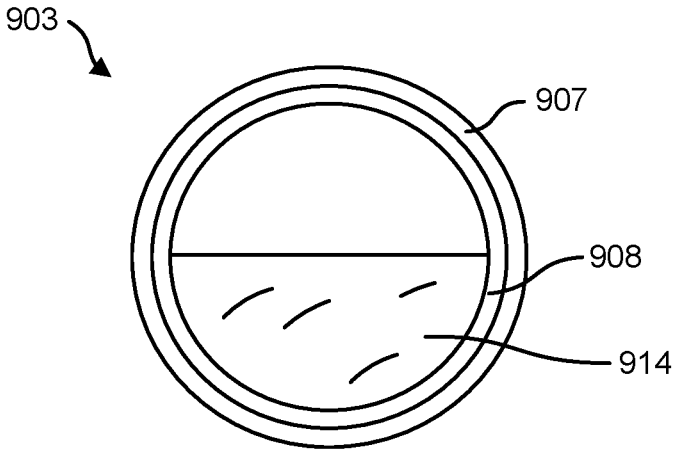

FIGS. 9A and 9B illustrate yet another exemplary thermal wick, thermal wick 903. FIG. 9B is an inner cross-sectional view of the thermal wick 903. A thermally conductive core 908 is surrounded by a porous wicking material 907. The thermally conductive core 908 is a hollowed chamber or tube in which a fluid 914, such as water, may be placed. The ends of the thermal wick may be sealed or capped with caps 912, which may be formed of the same material as the thermally conductive core 908. This configuration results in significant heat transfer improvements and has a low thermal mass due to the hollow configuration of the core 908.

Any of the thermal wicks described herein may include voids/air gaps within the core region. Further, any of the core regions including a high thermal conductivity material may be formed into a filament, rope, bundle, chain, weave, braid, or the like, and may generally extend along all or a majority of the length of the thermal wick. The ends of the thermal wick may be open (e.g., exposing the high thermally conductive material to the vaporizable material in the reservoir) or they may be covered by the outer wicking material (e.g., low thermal conductivity material or insulating material) or by another material.

In any of the thermal wicks described herein, additional stands or lengths of high thermal conductivity materials may extend through the length of the thermal wick; for example, in FIG. 8B, the central region may include one or more additional strands, braids, etc. of the high thermal conductivity material. As mentioned, any of these thermal wick may include a plurality of voids/air gaps within the volume of the thermal wick. For example, the volume may include 2% or more, 3% or more, 4% or more, 5% or more, 7% or more, 10% or more, 12% or more, 14% or more, 15% or more, 20% or more, 22% or more, 25% or more, etc. of voids/air gaps. These voids/air gaps may be near or adjacent to the high thermal conductive material.

In general, the thermal wicks described herein may be any appropriate diameter and length. For example, the thermal wick may have a diameter of 0.5 mm-10 mm and a length of between 0.5 mm and 30 mm.

In accordance with additional aspects of the current subject matter, a thermal wick may have a core containing between 1 and 10,000 strands in a variety of orientations. The strand diameters may range from, for example, 0.005 mm to 9.000 mm. The thermal core may also be a tube, or tubes, e.g., of 0.25-9.25 mm outside diameter with a length of 0.5-30 mm. The tube(s) may also have radial holes or slots to facilitate fluid transfer out of or between the tube(s). The thermal core may also be made of standard wicking fibers, such as silica, which are co-woven with some fraction of metallic fibers of a similar diameter. Metallic fiber fractions may range from 1-99%. The outer 0.25 mm, for example, of this core may be made of non-conductive (e.g., non-metallic) wicking material, including fibers, to prevent the heating coil from shorting.

Another variation of a thermal wick according to implementations of the current subject matter may be referred to as a chimney coil configuration in which the entire thermal wick forms a tube. The inside of the tube may be formed by a heating coil. A wicking material (e.g. silica) may be positioned around this coil. A thermally conductive material may then be positioned around the wicking element, and may also be in fluid communication with the liquid reservoir and any vaporizable material therein.

In some variations, the thermal wick may also act as a heater. This wick/heater may be comprised of an open porous metal structure with similar overall dimensions to a standard silica wick. The porous element may be formed by sintering powdered metal particles of the appropriate size and composition such that the wick/heater has desirable wicking characteristics and appropriate resistance for the desired power supply/power output. For example, a porous metal heater/wick, 1×10 mm, may be comprised of nickel chromium with a porosity of 50% and a resistance of 0.2 Ohms. Electrical connections may be made by directly welding leads to the "heater" portion of the wick. The ends of the wick may extend past the electrical leads in order to transfer thermal energy into the liquid reservoir.

Figure 10:
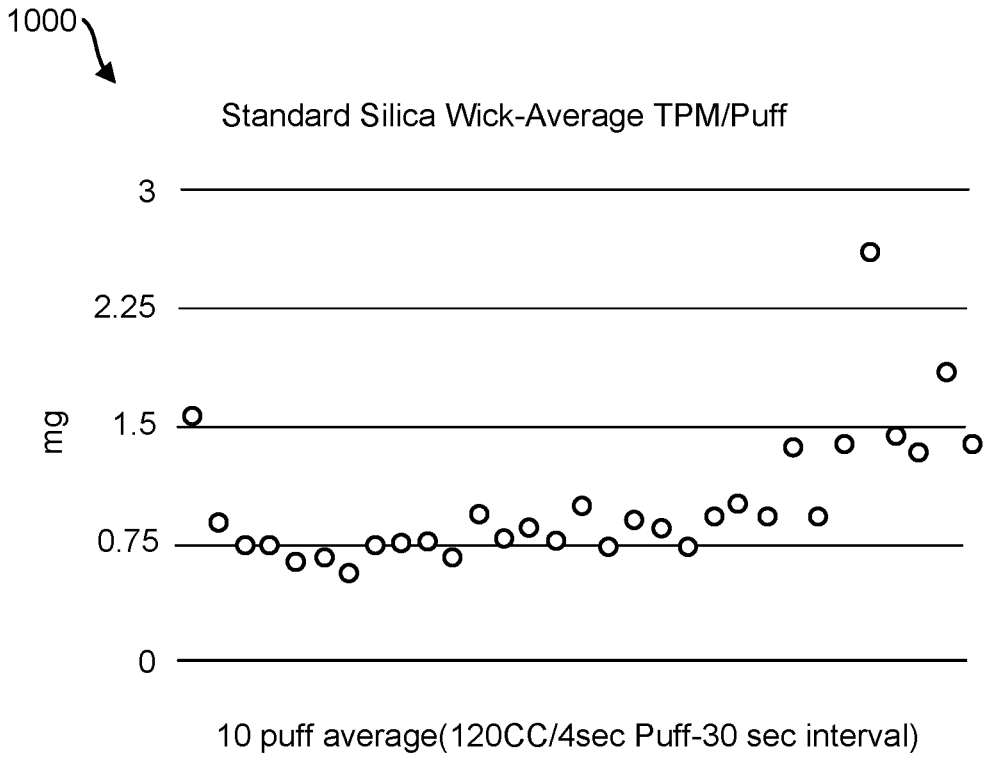
FIG. 10 illustrates, via a graph, total particulate mass (TPM) of vaporizable material vaporized with a traditional silica wick.

FIG. 10 illustrates, via a graph 1000, total particulate mass (TPM) of vaporizable material vaporized with a traditional silica wick, and FIGS. 11-15 illustrate, via graphs 1100-1500, TPM of a vaporizable material vaporized with thermal wicks consistent with various implementations of the current subject matter.

Figure 11:
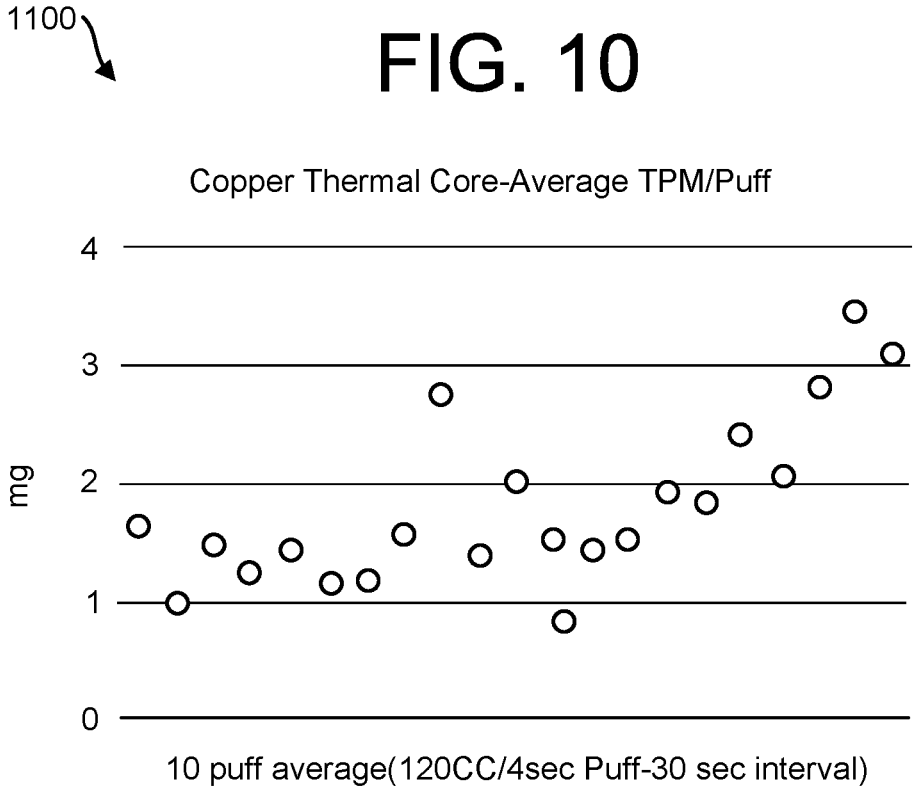
FIGS. 11-15 illustrate, via graphs, TPM of a vaporizable material vaporized with wicks consistent with various implementations of the current subject matter.

In FIGS. 10 and 11, a thermal wick having a copper core (graph 1100 in FIG. 11) is compared to a standard silica wick (graph 1000 in FIG. 10). The standard silica wick does not include a high thermal conductivity material. The copper core of the wick for which the data of FIG. 11 is shown is a 26 strand bundle of nickel plated copper wire, each of ~0.2 mm in diameter. The cartridge used for the results is similar to that shown in FIGS. 2 and 3 and was inserted into a vaporizer providing power to the electrodes heating the resistive coil. The same device was used for the tests of FIGS. 10-15 and tests were performed at 420° C. Each data point represents the average TPM of oil vaporized over 10 puffs. Each puff volume/rate was precisely controlled by a piston-driven smoking machine. Each cartridge was filled with approximately 0.5 g of the same oil. As shown in FIG. 10, the TPM/puff for the silica wick over time varied between about 0.6 and 1.8 mg, with a total average of approximately 1 mg/puff. In contrast, when a thermal wick (having a core of a copper material, as described above, surrounded by a silica sleeve) was used with identical parameters, the TPM/puff varied between 1 and 3.2 mg, with a total average of about 1.9 mg/puff. This comparison shows that there is an almost two-fold increase in vapor production from the copper thermal wick compared to a standard wick. In use, this may translate to a larger volume of vapor, and/or an easier draw experience for the user to inhale equivalent amounts of vapor.

Figure 12:
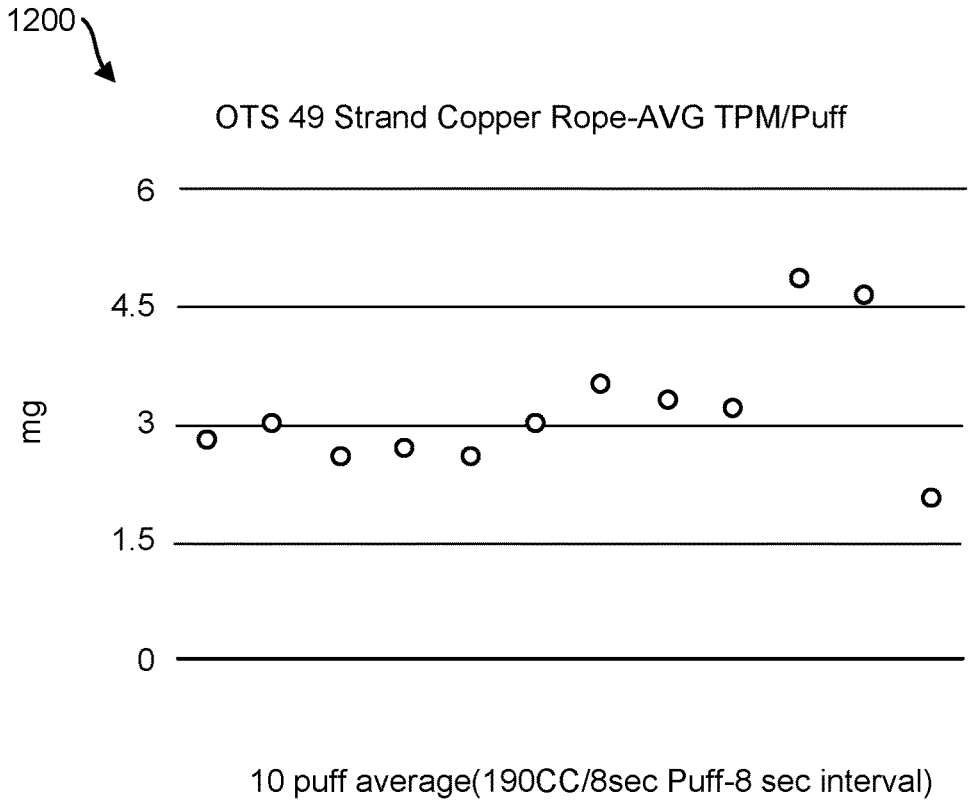
Figure 13:
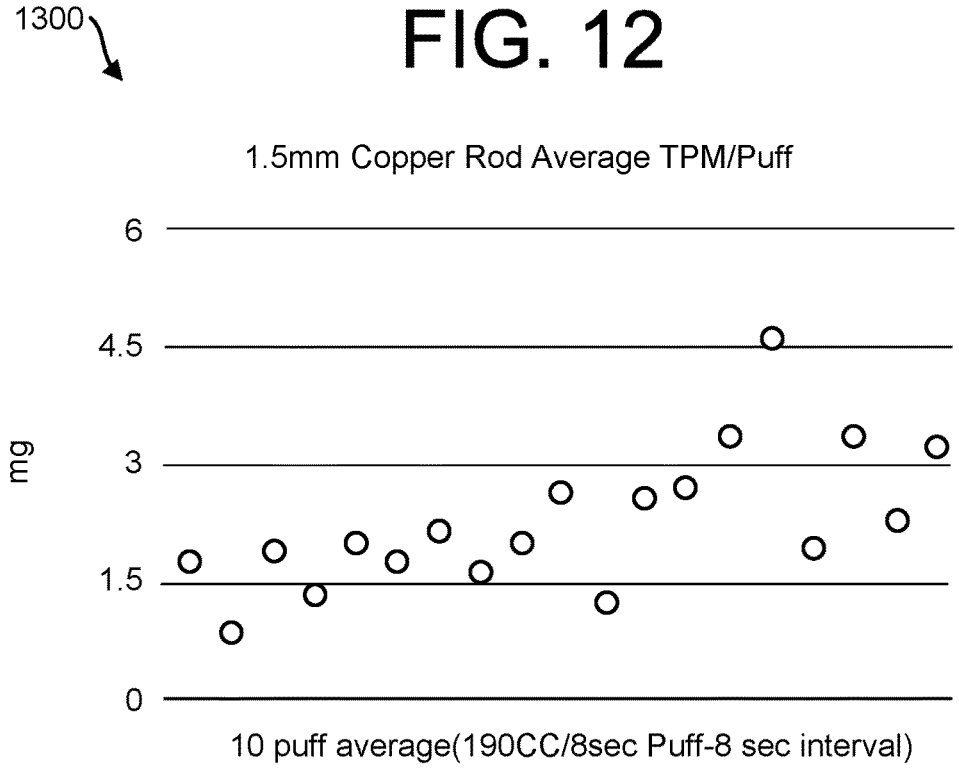

Similarly, FIGS. 12 and 13 show similar improvement when using thermal wicks that include a copper core formed of a different braided material (graph 1200 in FIG. 12) or a solid copper core (graph 1300 in FIG. 13). As before, the same vaporizer system was used, and tests were run at 320° C. Each data point represents the average TPM of oil vaporized over 10 puffs. Each puff volume/rate was precisely controlled by a piston-driven smoking machine. Cartridges were filled with approximately 0.5 g of the same oil. In FIG. 12, a 49-strand copper core (an analog to the variation shown in FIG. 11), had a total average TPM of 3.2 mg/puff. When a 1.5 mm copper rod, surrounded by the silica wicking material was used instead, as shown in FIG. 13, the total average TPM was 2.2 mg/puff.

Although the solid copper rod core (FIG. 13) has the same outer diameter (OD) as the copper rope (FIG. 12), with similar axial thermal conductivity and mass, the thermal wick having the solid copper rod has a 31% decrease in performance (2.2 mg/puff average) compared to the copper rope. Thus, increased thermal conductivity may be only part of the mechanism by which the thermal wick increases performance. Thermal core geometry, as it relates to void volume/carrying capacity, may also be considered to maximize performance.

Figure 14:
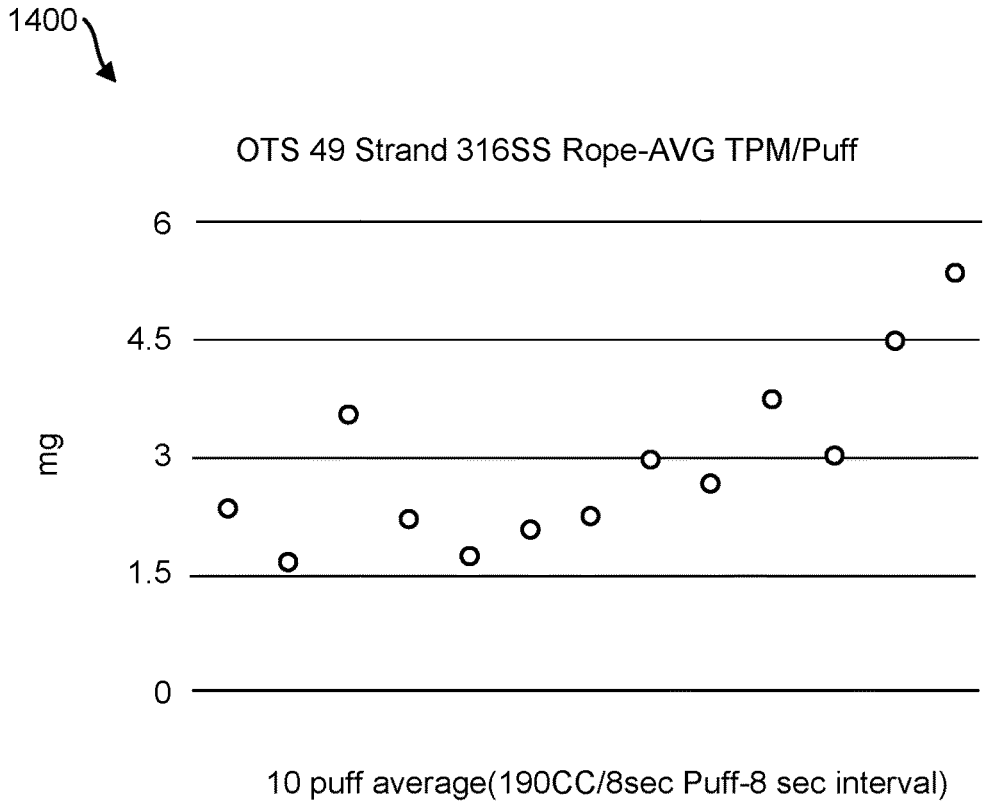
Figure 15:
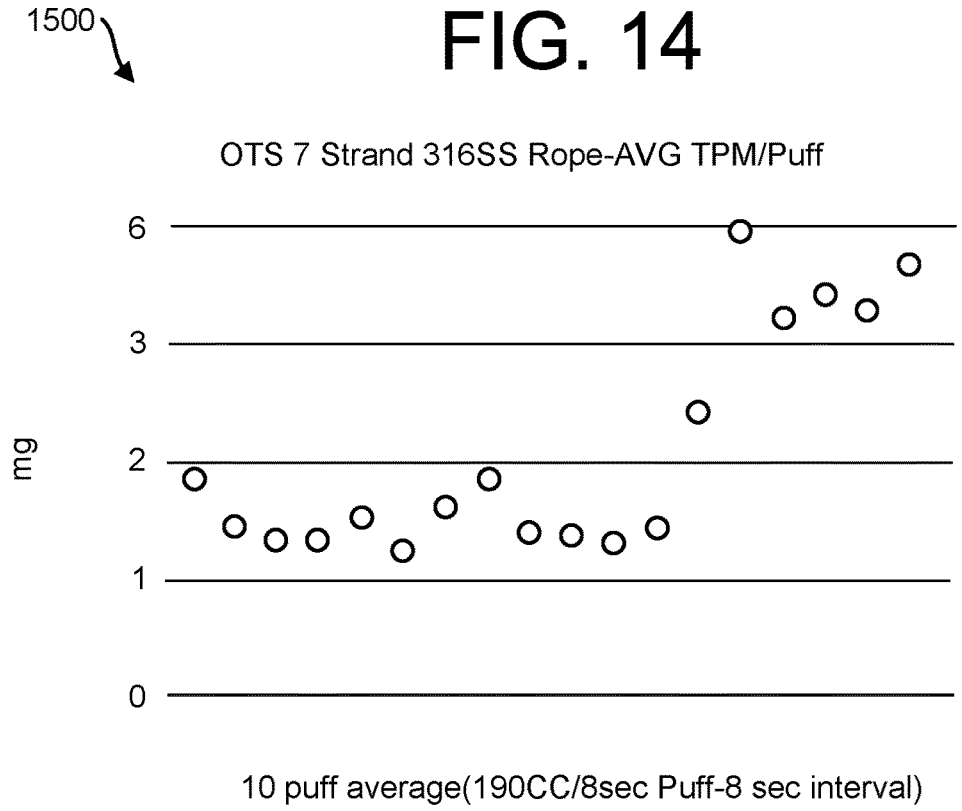

Similar results were achieved with different high thermal conductivity materials, such as stainless steel. For example, FIGS. 14 and 15 show tests performed as above, in which the thermal wick included an outer cover of silica and an inner core formed of 316 stainless steel. In graph 1400 of FIG. 14, with the stainless steel rope (e.g., OTS 40 strand 316 stainless steel) forming the thermal wick, the average total average TPM was 2.9 mg/puff. In graph 1500 of FIG. 15, the thermal wick tested was formed of a rope of stainless steel having 7 strands (OTS 7 Strand 316 Stainless Steel), and the total average TPM was 2.1 mg/puff.

As shown in FIG. 14, surprisingly, a thermal wick formed from an off the shelf 49 strand 316 stainless steel rope core had a similar performance to the copper rope (e.g., showed only a 9% decrease in performance compared to the copper rope). As the thermal conductivity of 316 stainless steel is 96% less than copper, this indicates that the void geometry and carrying capacity of the stranded core is likely to significantly contribute to the thermal wick's performance. This is further substantiated by the performance of the off the shelf 7 strand 316 stainless steel rope core, which performed 34% worse than the copper rope and 28% worse than the 49 strand stainless rope. The 7 strand rope (FIG. 15) is made from 7 large wires, while the 49 strand rope (FIG. 14 for stainless steel and FIG. 12 for copper) is made from 7 large bundles of 7 smaller strands each. So, while the overall dimensions are roughly the same, the 7 strand rope has ~18% more mass than the 49 strand rope, yet the 49 strand rope has significantly more carrying capacity between the individual strands. Therefore, it is not only the greater thermal mass of the of the 7 strand rope which decreases its performance relative to the 49 strand stainless rope, but also its reduced porosity/carrying capacity.

All of the thermal wick configurations tested above performed better than the standard wick, as clearly illustrated in FIGS. 10-15. As shown, a higher thermal conductivity material having a higher void volume/carrying capacity maximizes performance of a thermal wick. These attributes decrease fluid viscosity in and around the wick, thereby increasing wicking rate, while allowing air exchange with less pressure differential.

Figure 16:
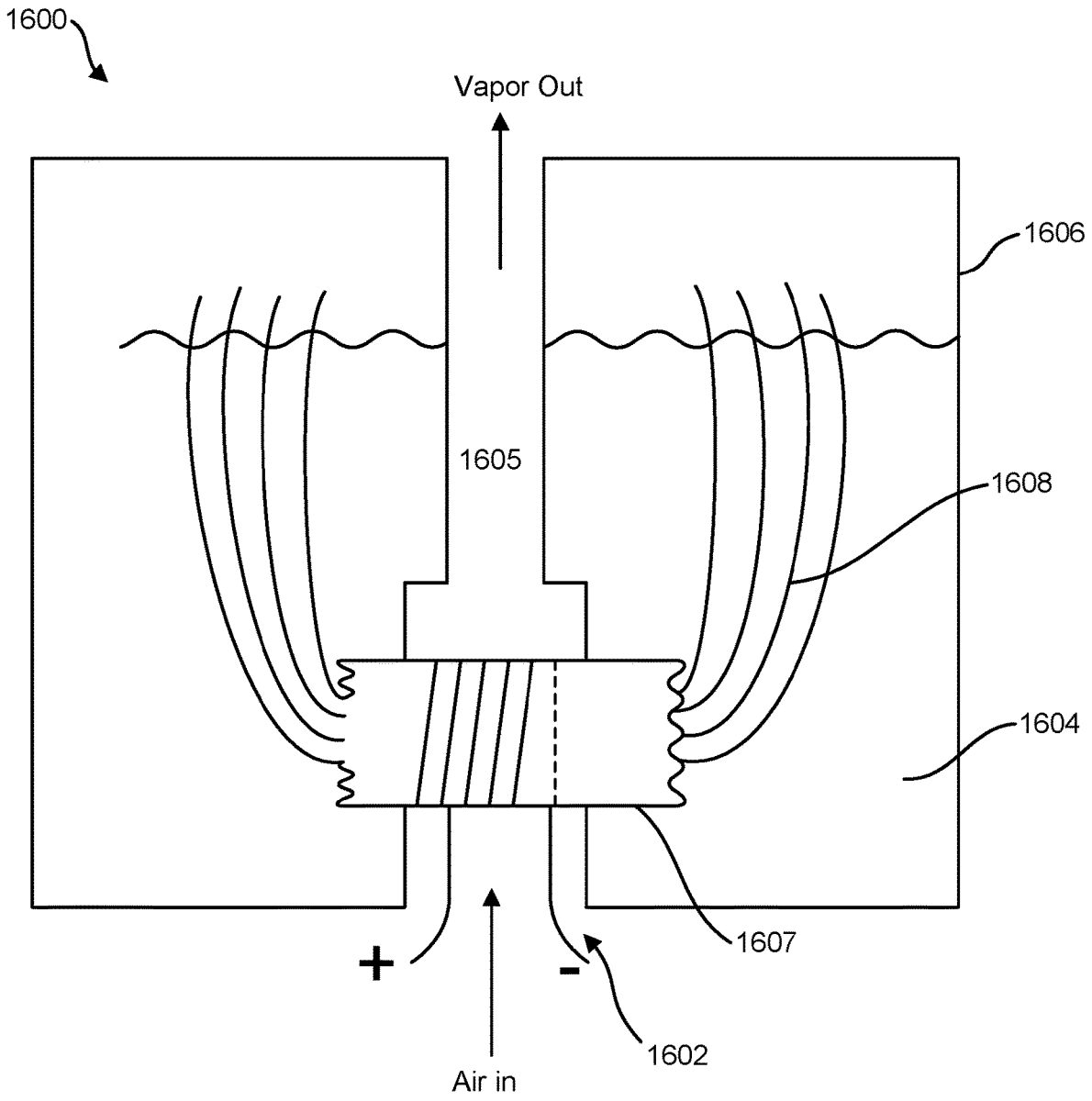
FIG. 16 illustrates a schematic representation of an apparatus in which a wick consistent with additional implementations of the current subject matter may be incorporated.

FIG. 16 illustrates a schematic representation of a cartridge 1600 in which a thermal wick consistent with additional implementations of the current subject matter may be incorporated. In this example configuration, the cartridge 1600 may be filled with a non-flowing (at room temperature) vaporizable material 1604, such as a wax. A thermal wick shown in FIG. 16 may be similar in configuration to the various embodiments described above. One potential difference may be that the outer region (e.g., a nonconductive sleeve, such as a silica sleeve) 1607 may be a shorter length than the inner core material 1608, which may extend past the sleeve on both ends to fill or extend into at least a portion of reservoir 1606. When heater coil 1602 is activated, heat may transfer along the core strands 1608 through the entire bulk of material of the thermal wick and in the reservoir 1606. For very viscous materials, simple on-demand heating of this coil may not provide sufficient heat into the reservoir to lower the viscosity enough for wicking. However, in any of the apparatuses and methods described herein, a preheat mode can be utilized along with the disclosed implementations to allow rapid wicking of the vaporizable material. During a preheating mode, the coil may be preheated to a temperature below the desired vaporization temperature, e.g. 100° C.-200° C. After a short wait (e.g., between 5 seconds and 2 minutes, between 30 and 60 seconds, etc.), the metal core may have transferred enough heat to the reservoir 1606 so that the material readily wicks, and the user may take a puff. When the device senses a puff (using a lip sensor, a puff sensor, or the like), the coil 1602 may heat to vaporization temperature, e.g. 350° C. (e.g., between 250° C. and 500° C.). Once the puff stops, the coil 1602 may return to its lower preheat temperature so that the wick remains saturated for subsequent puffs. If no puff is taken for a significant amount of time, the coil 1602 may turn off completely to conserve energy. Alternate variations of this design may include a silica sleeve which extends the entire length of the metal core. In some variations, the apparatus may include a control (e.g., button) for manual preheating (such as holding a button for a period of time before taking a puff).

The preheating operation and mode may be implemented with any of the thermal wicks and cartridges/devices described herein.

The thermal wick configuration consistent with implementations described herein is found to enhance performance of the vaporizer in vaporizing a vaporizable material. The increase in thermal conductivity of the wick (due to the thermally conductive material) allows the length of the wick to reach higher temperatures. This increase in temperature lowers the viscosity of the fluid in the wick, and in the reservoir, primarily in the portion of the reservoir near the wick ends. This lowered viscosity in turns allows bulk flow/capillary action through the wick to happen at a faster rate and allows air to return to the reservoir through the wick with less pressure drop. The large metal strands of the wick may also provide a greater void volume in the wick. This larger void volume means more oil carrying capacity near the heater, so a longer puff can be taken before depleting the fluid in the vicinity of the heater. Additionally, the larger voids/channels allow axial air exchange to happen with less pressure drop.

Figure 17:
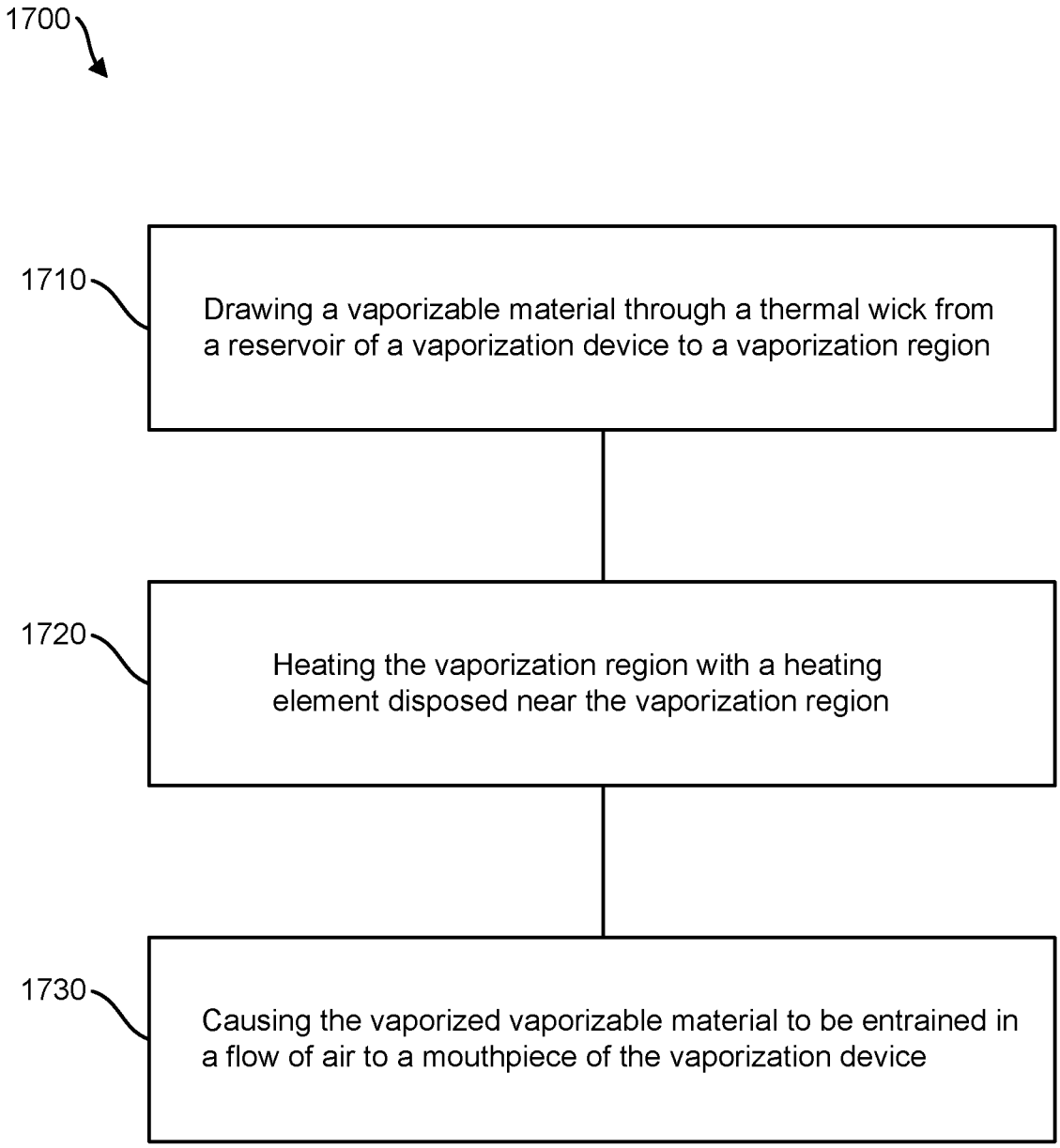
FIG. 17 shows a process flow chart illustrating features of a method of drawing a vaporizable material and causing vaporization of the vaporizable material in a vaporization device consistent with implementations of the current subject matter.

With reference to FIG. 17, a process flow chart 1700 illustrates features of a method, which may optionally include some or all of the following. At 1710, a vaporizable material is drawn, through a wick, from a tank of a vaporization device to a vaporization region. At 1720, the vaporization region is heated with a heating element disposed near the vaporization region. The heating causes vaporization of the vaporizable material in the vaporization region. At 1730, the vaporized vaporizable material is entrained in a flow of air to a mouthpiece of the vaporization device.

The apparatuses (devices, systems, components, cartridges, etc.) including vaporizers, vaporizer cartridges, and methods described herein may be used to generate an inhalable vapor, an in particular may result in a greater amount of vapor production compared to currently available devices. Thus, described herein are apparatuses and methods for modifying (e.g., reducing) the viscosity by heating an oil (or wax) vaporizable material before and/or as it enters the wick from which it can be vaporized. These apparatuses may be particularly useful as cannabis oil devices, e.g., apparatuses for vaporizing cannabis oils. In any of the apparatuses and methods described herein, a thermally conductive core may be included or incorporated as part of an atomizer wick, which may reduce the viscosity of the vaporizable material (e.g., an oil including cannabis oils) that are to be vaporized.

For example, described herein are vaporizer devices having a thermally conductive wick, the device comprising: a reservoir configured to hold a vaporizable material; an elongate thermal wick having a length, the elongate thermal wick comprising: a first material that is porous, and a second material having a thermal conductivity that is more than 5× greater than the thermal conductivity of the first material; and a resistive heater wrapped at least partially around the elongate thermal wick, wherein the first material electrically insulates the second material from the resistive heater; further wherein the elongate thermal wick extends into the reservoir so that vaporizable material in the reservoir may be wicked into the elongate thermal wick.

Both the second and first materials may extend down the length of the thermal wick. The first material may be a cover or a sleeve that is radially around the second material.

The thermal wick may generally have an elongate cylindrical shape, and may have an outer layer of the first material enclosing the second material. The second material may be exposed at the ends of the thermal wick.

The first material may be one or more of a silica, a cotton, and/or a ceramic The first material may comprises a fibrous material. The second material may be a metal or alloy. The second material may be, for example, a copper or copper alloy, and/or a stainless steel. The second material may have a thermal conductive that is 4 W/mK or greater at 25° C., or a thermal conductivity that is 10 W/mK or greater at 25° C. The second material may be a braided material.

In any of these devices, the thermal wick may have a plurality of voids/air gaps through thermal wick volume. For example, the thermal wick may have a void volume of 2% or more (e.g., 3% or more 4% or more, 5% or more, 6% or more, 7% or more, 8% or more, 9% or more, 10% or more, etc.) of the thermal wick volume.

The resistive heater is generally in thermal communication with the thermal wick so that heating the resistive heater warms the second material. For example, the resistive heater may be a coil that is wrapped around or embedded within the thermal wick.

Any of the devices described herein may be configured as cartridges for use with a vaporizer body having a battery and control circuitry.

Further, any of these devices may include the vaporizable material, such as a cannabis oil and/or wax.

For example, a vaporizer device having a thermally conductive wick may include: a reservoir configured to hold a vaporizable material; an elongate thermal wick having a length, the elongate thermal wick comprising: a first material that is porous and has a thermal conductivity that is less than 3 W/mK at 25° C., and a second material having a thermal conductivity that is more than 5 W/mK at 25° C.; and a resistive heating coil wrapped around the elongate thermal wick, wherein the first material electrically insulates the resistive heater from the second material; further wherein the elongate thermal wick extends into the reservoir so that vaporizable material in the reservoir may be warmed by the second material when the resistive heating coil is heated and wherein the vaporizable material may be wicked into the elongate thermal wick.

Also descried herein are methods of using any of the vaporizers described herein. For example, a method of vaporizing a vaporizable material using a vaporizer having a thermal wick comprising a porous wicking material and a high thermal conductivity material may include: applying energy to a resistive heater to a vaporizing temperature; conducting heat from the resistive heater into a reservoir of the vaporizer through the high thermal conductivity material that is electrically isolated from the resistive heater by the porous wicking material to reduce the viscosity of the vaporizable material, wherein the high thermal conductivity material has a thermal conductivity that is at least 5× greater than the thermal conductivity of the porous wicking material; and vaporizing the vaporizable material.

Any of these methods may include applying energy to the resistive heater by applying energy to a resistive coil wrapped around the thermal wick.

Any of these methods may include conducting heat from the resistive heater by conducting heat through a braided core of the high thermal conductivity material extending down the length of the thermal wick, and/or by conducting heat through a braided stainless steel, copper and/or copper alloy extending down the length of the thermal wick. Alternatively or additionally, conducting heat from the resistive heater may comprise conducting heat through the porous wicking material to the high thermal conductivity material in the core of the thermal wick, wherein the porous wicking material comprises one or more of: a silica, a cotton, and a ceramic.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments and implementations only and is not intended to be limiting. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the teachings herein. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A cartridge for a vaporization device, the cartridge comprising:

a mouthpiece;

a reservoir configured to hold a vaporizable material;

a wick configured to draw a portion of the vaporizable material from the reservoir to a vaporization region, the wick comprising a thermally conductive core comprising a plurality of thermally conductive strands, and a porous wicking material surrounding a circumference of the plurality of thermally conductive strands, the thermally conductive core being more thermally conductive than the porous wicking material; and a heating element disposed near the vaporization region and configured to heat the portion of the vaporizable material drawn from the reservoir;

wherein a portion of each of one or more of the plurality of thermally conductive strands extends beyond at least one outer edge of the porous wicking material into the reservoir; and wherein the portion of each of the one or more of the plurality of thermally conductive strands is configured to conduct heat to the vaporizable material within the reservoir and increase fluidity thereof.

2. The cartridge of claim 1, wherein the heating element at least partially encircles at least a portion of the wick, and wherein the porous wicking material electrically isolates the plurality of thermally conductive strands from the heating element.

3. The cartridge of claim 1, wherein the wick further comprises a plurality of voids interspersed throughout the plurality of thermally conductive strands.

4. The cartridge of claim 1, wherein the wick comprises a void volume of at least 5% of a total volume of the wick.

5. The cartridge of claim 1, wherein the wick further comprises a sleeve radially encircling the porous wicking material and the thermally conductive core.

6. The cartridge of claim 1, wherein the one or more of the plurality of thermally conductive strands are exposed at one or more ends of the wick.

7. The cartridge of claim 1, further comprising an air inlet passage configured to direct a flow of air over the wick such that when the heating element is activated, the portion of the vaporizable material drawn by the wick into the vaporization region is evaporated into the flow of air.

8. The cartridge of claim 1, wherein the mouthpiece is disposed at a first end of a body of the cartridge and the heating element is disposed at a second end of the body, the second end opposite the first end.

9. The cartridge of claim 1, further comprising a second heating element connected to the thermally conductive core and configured to control a temperature of the thermally conductive core.

10. A vaporization device comprising:

a reservoir configured to hold a vaporizable material;

a wick configured to draw a portion of the vaporizable material from the reservoir to a vaporization region, the wick comprising a thermally conductive core comprising a plurality of thermally conductive strands, and a porous wicking material surrounding a circumference of the plurality of thermally conductive strands, the thermally conductive core being more thermally conductive than the porous wicking material; and a heating element disposed near the vaporization region, the heating element configured to be heated to a vaporization temperature to aerosolize the portion of the vaporizable material;

wherein a portion of each of one or more of the plurality of thermally conductive strands extends beyond at least one outer edge of the porous wicking material into the reservoir, the portion of each of the one or more of the plurality of thermally conductive strands configured to heat the vaporizable material within the reservoir and increase fluidity thereof.

11. The cartridge of claim 3, wherein the plurality of thermally conductive strands are arranged into a plurality of groups of thermally conductive strands, and wherein one or more of the plurality of voids is disposed between adjacent ones of the plurality of groups of thermally conductive strands.

12. The cartridge of claim 1, wherein the plurality of thermally conductive strands are configured to be heated by one or more of conduction or convection from the heat generated by the heating element.

13. The cartridge of claim 1, wherein the plurality of thermally conductive strands are configured to be heated to a temperature lower than a vaporization temperature of the heating element.

14. The vaporizer device of claim 10, further comprising a second heating element connected to the thermally conductive core and configured to control the temperature of the thermally conductive core.

15. The vaporizer device of claim 10, wherein the wick further comprises a plurality of voids interspersed throughout the plurality of thermally conductive strands.

16. The vaporizer device of claim 10, wherein the plurality of thermally conductive strands are configured to be heated by one or more of conduction or convection from the heat generated by the heating element.

17. The vaporizer device of claim 10, wherein the heating element at least partially encircles at least a portion of the wick, and wherein the porous wicking material electrically isolates the plurality of thermally conductive strands from the heating element.

18. The vaporizer device of claim 10, wherein the plurality of thermally conductive strands are configured to be heated to a temperature lower than the vaporization temperature of the heating element.

19. A cartridge for a vaporization device, the cartridge comprising:

a mouthpiece;

a reservoir configured to hold a vaporizable material;

a wick configured to draw a portion of the vaporizable material from the reservoir to a vaporization region, the wick comprising a thermally conductive core and a porous wicking material surrounding at least a portion of the thermally conductive core, the thermally conductive core being more thermally conductive than the porous wicking material;

a first heating element disposed near the vaporization region and configured to heat the portion of the vaporizable material drawn from the reservoir; and a second heating element connected to the thermally conductive core and configured to control a temperature of the thermally conductive core.

20. The cartridge of claim 19, wherein the thermally conductive core comprises a thermally conductive rod.

21. The cartridge of claim 19, wherein the thermally conductive core comprises a plurality of thermally conductive strands.

22. A vaporization device comprising:

a reservoir configured to hold a vaporizable material;

a wick configured to draw a portion of the vaporizable material from the reservoir to a vaporization region, the wick comprising a thermally conductive core comprising a plurality of thermally conductive strands, and a porous wicking material surrounding a circumference of the plurality of thermally conductive strands, the thermally conductive core being more thermally conductive than the porous wicking material;

a first heating element disposed near the vaporization region, the heating element configured to be heated to a vaporization temperature to aerosolize the portion of the vaporizable material; and a second heating element connected to the thermally conductive core and configured to control the temperature of the thermally conductive core.

23. The vaporization device of claim 22, wherein the thermally conductive core comprises a thermally conductive rod.

24. The vaporization device of claim 22, wherein the thermally conductive core comprises a plurality of thermally conductive strands.

* * * * *